US005359829A

United States Patent [19]

Voita

[11] Patent Number: 5,359,829

[45] Date of Patent: Nov. 1, 1994

[54] FABRICATION AND INSTALLATION OF STEEL REINFORCEMENT CAGES FOR PIER FOUNDATIONS

[76] Inventor: John M. Voita, 2502 E. Elm, Phoenix, Ariz. 85016

[21] Appl. No.: 986,454

[22] Filed: Dec. 7, 1992

[51] Int. Cl.[5] ..... E04B 1/18

[52] U.S. Cl. ..... 52/742; 52/649.4; 405/239

[58] Field of Search ..... 52/648.1, 649.2, 649.3, 52/649.4, 742, 651.7; 405/239

[56] References Cited

U.S. PATENT DOCUMENTS

| | | | |
|---|---|---|---|
| 517,808 | 4/1894 | Ransome | 52/649.3 |
| 1,008,209 | 11/1911 | Skinner | 52/649.4 |
| 1,708,277 | 4/1929 | Martin | 52/649.4 |
| 3,110,982 | 11/1963 | Besinger | 52/649.2 |
| 4,269,544 | 5/1981 | Rusche | 405/233 |
| 4,377,928 | 3/1983 | Hasak | 52/649.4 |
| 4,467,583 | 8/1984 | Hasak | 52/649.4 |
| 4,627,211 | 12/1986 | Foster, Jr. | 52/649.4 |

FOREIGN PATENT DOCUMENTS

| | | | |
|---|---|---|---|
| 404563 | 12/1909 | France | 52/653 |

*Primary Examiner*—Peter M. Cuomo
*Assistant Examiner*—Darnell Boucher
*Attorney, Agent, or Firm*—Christopher A. Klein; James Duffy

[57] ABSTRACT

A method and apparatus for fabricating a drilled, concrete pier in the earth at a construction site is disclosed. The method comprises the steps of providing a template from which vertical reinforcement bars may be suspended and disposed in spatial alignment generally defining the periphery of the reinforcement cage. All the vertical reinforcement bars of the reinforcement cage are suspended in vertical disposition from the template. Horizontal ties are positioned at selected sides along the length of the reinforcement bars, and are fastened to the vertical reinforcement bars at said sites. In this way, fabrication of the reinforcement cage is completed while the cage is vertically suspended from the template. The reinforcement cage can be fabricated and suspended directly above, and later lowered into, a hole drilled in the earth for a drilled pier foundation.

6 Claims, 2 Drawing Sheets

20
21
22
23
24
25
26
27
28
29
30
31
32
33
34
39

FABRICATION AND INSTALLATION OF STEEL REINFORCEMENT CAGES FOR PIER FOUNDATIONS

BACKGROUND

1. Technical Field of the Invention

The invention relates to "drilled pier" foundations. Specifically, the invention relates to the construction and installation of steel reinforcement cages in such drilled foundations and the placement of concrete therein. Most particularly, the invention discloses improved method and apparatus for the assembly and placement of such steel reinforcement cages.

2. Prior Background Art

The thump, and the thump, and the thump of the pile driver was once a familiar sound at construction sites. The sound occurs today with no where near the frequency with which it occurred in the past. More modern practice has been to drill a foundation hole into which steel reinforcement is placed and concrete poured.

As a foundation hole is being drilled, a work crew at the construction site assembles a cage of steel reinforcing bars. The resulting cage is an open cylindrical structure of steel reinforcing bars. The finished cage is disposed generally parallel to the surface of the ground above which the cage has been constructed.

The next step requires the use of a crane to lift the cage from the ground and orient it in a vertical disposition so that it can be introduced into the foundation hole which has been drilled into the earth. For relatively short reinforcing cages, the lifting of the cage is accomplished relatively easily with the assistance of workers on the ground guiding the cage as it is raised to a vertical position. The short lengths of such cages permit their lifting with minimal distortion occurring as one end of the cage is lifted while the opposite end is still bearing on the earth.

The reality of the "One hundred year flood" or the "maximum anticipated wind loading" on structures built in this fashion in the not so distant past have often shown that pier loading specifications have not been conservative enough. In addition, improvements in the art of manufacture of pre-cast concrete structural elements have increased the length of bridge spans, and the like, far beyond that anticipated in the prior art. Such factors have combined such that foundation pier loading specifications often require the on-site fabrication of steel reinforced concrete piers having diameters in excess of ten feet and axial lengths of a hundred feet or more.

When a cage of reinforcing steel is constructed on the ground and its length approaches or even exceeds one hundred feet in length, the lifting of that cage to a vertical disposition without adverse distortion becomes problematical. Despite sophisticated rigging techniques, noticeable bowing of such cages may be observed as they are raised to the vertical. The degree of such distortion may sometimes exceed the safety limit imposed on the cage structure. There is always the possibility that such excess distortion may have occurred inadvertently unnoticed by the on site inspection team.

It is an object of the present invention that the reinforcing steel cage shall be constructed in a vertical disposition such that the structure is never subjected to bending stresses as experienced in the prior art method of constructing cages horizontal to the ground.

It is a further objective of the invention that ready access to the interior of the reinforcing cage shall be provided for inspection purposes of the alignment of the cage within the earth-drilled pier hole.

It is another objective of the invention to provide for the ready, vertical alignment of the cage within the hole. Additionally, provision is made for the enhanced safety of workman employed adjacent to the reinforcing cage as it is lowered into and positioned within the earth-drilled pier hole.

SUMMARY DESCRIPTION OF THE INVENTION

The invention is a method for fabrication of a steel reinforcement cage for use in drilled pier foundations. The reinforcement cage comprises vertical reinforcement bars and horizontal ties. The method comprises the steps of providing a template from which the vertical reinforcement bars may be suspended and disposed in spatial alignment generally defining the periphery of the reinforcement cage. All the vertical reinforcement bars of the reinforcement cage are suspended in vertical disposition from the template. Next is positioned a horizontal tie at a selected site along the length of the reinforcement bars. The horizontal tie is fastened to the bars at the selected site. The step of positioning and fastening the horizontal ties to the vertical reinforcement bars is repeated until all the horizontal ties of the reinforcement cage have been positioned and fastened to all the vertical reinforcement bars.

The fabrication of the reinforcement cage is completed while the cage is vertically suspended from the template. The template is held in a vertically adjustable disposition. The disposition of the template and any of the vertical reinforcement bars suspended therefrom may be adjusted vertically. In performing this step, the suspending of the template in a vertically adjustable disposition is achieved by suspending the template from the hoist rigging of a crane. In its vertically adjustable disposition, the template is suspended above a hole drilled in the earth for the drilled pier foundation.

The steel reinforcement cage is used in the drilled pier foundation by lowering the reinforcement cage into the hole, filling the cage and the hole with concrete, and removing the template from the vertical reinforcement bars by cutting the bars at a predetermined elevation for the site.

Apparatus for fabricating a steel reinforcement cage for use in a drilled pier foundation comprises vertical reinforcement bars for use in fabricating the vertical sides of a steel reinforcement cage. Horizontal ties are provided for coupling to the vertical reinforcement bars to maintain the bars in selected disposition for forming the steel reinforcement cage. A bar-suspending template has the vertical reinforcement bars suspended therefrom in selected disposition for forming the vertical sides of the reinforcement cage. There are means, such as wire ties, for coupling the horizontal ties at selected positions on the vertical reinforcement bar. The horizontal ties are wired to the vertical reinforcement bars while the bars are suspended from the template. Thus, the reinforcement cage is formed and fabricated in a suspended disposition.

DETAILS OF BEST MODE FOR CARRYING OUT THE INVENTION

Figures 1, 2, 3, 4:
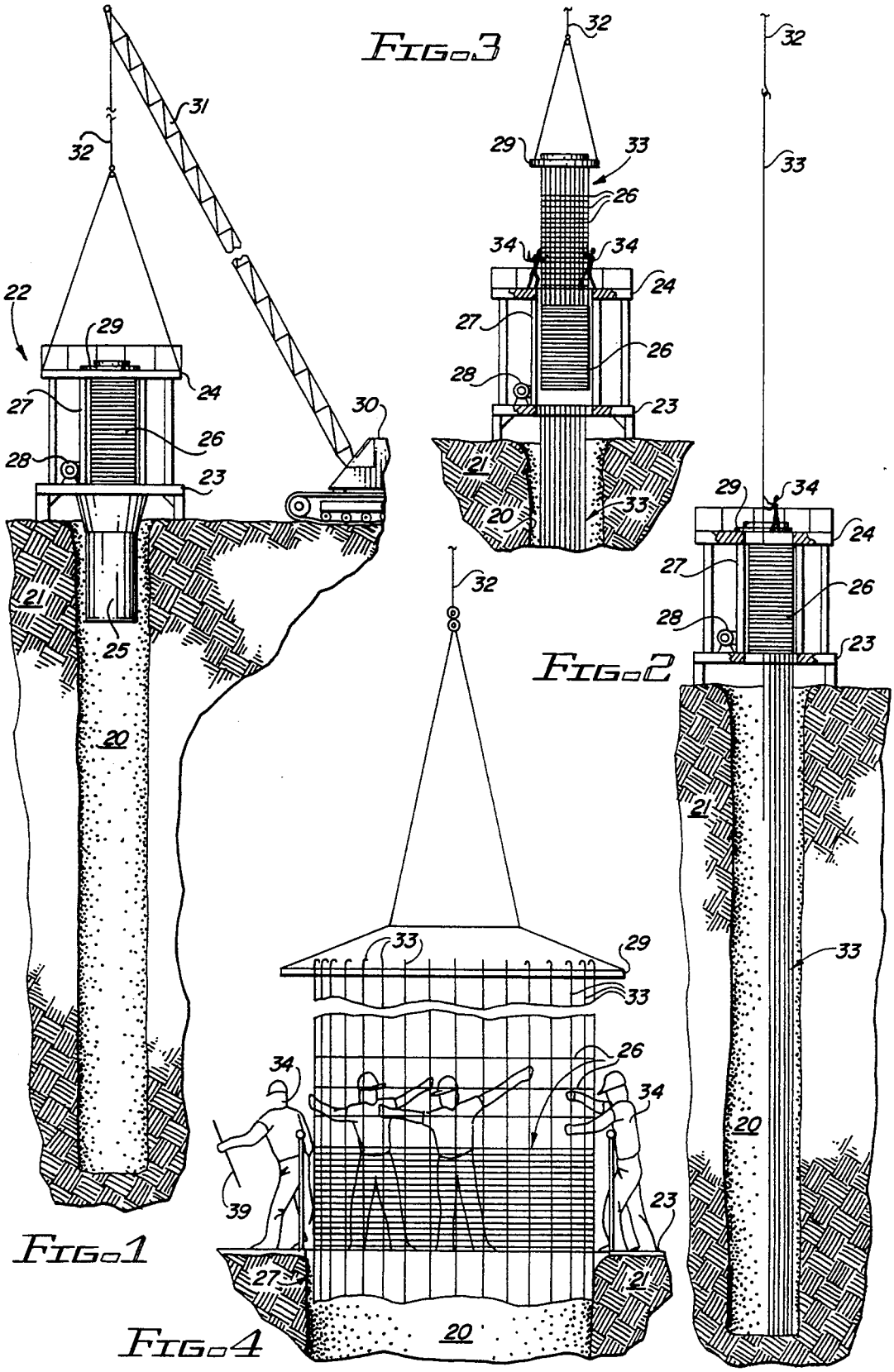
FIG. 1 is a cross-sectional view of the earth at a construction site at which a drilled, reinforced, concrete pier is to be constructed- Work platforms for assembling the reinforcing cage are shown positioned on the earth above the drilled hole.
FIG. 2 is similar to the illustration to FIG. 1 and shows a workman guiding a vertical reinforcing bar down through a bar-suspension template into the hole in the earth.
FIG. 3 illustrates the manner in which the vertical reinforcing bars, after having been attached to the suspension template, are lifted gradually from the hole to permit the attachment of horizontal tie rings thereto.
FIG. 4 is a detail showing the manner in which workman draw horizontal tie rings from a ready supply of rings to attach the same, by use of tie wires, to the vertical reinforcing bars of the reinforcing cage to be built.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

FIG. 1 is a side elevation view of the construction site showing the initial placement of apparatus employed in practicing the invention. The earth 21, shown in a sectional view, includes an excavated drill hole 20. Hole 20 has been drilled to the required depth, for example, a hundred feet, perhaps. Building site inspectors have inspected the hole and given approval for work to proceed. The ground surface about the top of hole 20 has been leveled to allow the placement of the apparatus utilized in practicing the invention.

Crane 30 having a boom 31 and cable rigging 32 is employed to bring a platform rig 22 to the drill hole and position the platform rig above the hole. Platform rig 22 has a lower platform 23, from which may be suspended a permanent steel encasement 25 for the finished reinforced concrete pier, if such encasement is required. Because steel encasement 25 is essentially optional except as required by the job site specifications, it will be omitted in the additional drawings which follow so that greater detail of the drawing may be shown and a greater understanding achieved.

On top of lower platform 23 has been positioned a plurality of horizontal ties 26. Ties 26 are essentially circular loops of reinforcing steel which will be used to tie the vertical steel reinforcement of the completed cage in position. The plurality of horizontal ties 26 have been emplaced in a motorized tie containment 27 which has been lifted by crane 30 into position atop lower platform 23. Motor 28 provides the motor force required to raise the stack of horizontal ties 26 upwards and out of motorized tie containment 27. The purpose for so lifting the ties will be disclosed in greater detail hereinafter.

Mounted above lower platform 23 and motorized tie containment 27 is upper work platform 24. Positioned on work platform 24 is a cage hanger template 29 from which will be hung, in vertical disposition and proper horizontal separation, the plurality of vertical reinforcing bars comprising the steel reinforcement cage to be built. Both upper platform 24 and lower platform 23 have a central opening through which the vertical steel reinforcing bars of the cage may be passed.

In FIG. 2, the reinforcing bars 33 which comprise the vertical components of the reinforcement cage to be built are lowered into position into the hole 30. These vertical bars 33 run the full length of the cage to be constructed. Where engineering specifications require, several bars may be bundled together for added strength at points of anticipated high stress. In the illustration of FIG. 2 several vertical reinforcing bars 33 have already been positioned within hole 20 and are suspended from template 29 on upper work platform 24. A workman 34 is guiding an additional bar 33 which is hanging suspended from cable/rigging 32. The workman guides a bar 33 through template 29 and anchors the top of the bar to template 29 so the bar may hang freely suspended from template 29.

Note that in inserting the vertical bars 33, as shown in FIG. 2, the bars are passed through the plurality of horizontal ties 26 which are positioned within motorized containment 27. This arrangement will permit the assembly of horizontal ties 26 to the vertical reinforcing bars 33 in the course of assembling the reinforcement cage.

As vertical bars 33 are inserted, their upper end is fastened to template 29 to support them in a vertical disposition with their distal end down in hole 20. When all vertical bars 33 have been passed into hole 20 and then positioned at template 29, crane 30, via cable rigging 32 raises template 29 and all the vertical bars 33 upwards a short distance above work platform 24. This operation is seen in the illustration of FIG. 3.

As template 29 and vertical bars 33 are raised above work platform 24, workman 34 actuate motor 28 to raise the horizontal tie rings 26 to a convenient working height such that the workman on platform 24 may position horizontal tie ring 26 at selected locations along vertical bars 33 and wire them in position using tie wires 39 (FIG. 4) in accord with good standard practices.

This procedure is shown in greater detail in FIG. 4 which illustrates template 29 having been raised sufficiently to permit workmen 34 to tie three horizontal ties 26 in position on the vertical reinforcing bars 33. The supply of additional horizontal ties 26 has been raised above the level of platform 23 so as to be conveniently available to be maneuvered by the workman 34. Crane 30 continues to lift template 29 via rigging 32 so as to raise the vertical reinforcement bars and the affixed horizontal bars 33 upward to permit workman 34 to continue with the tying of horizontal ties rings 26 to bars 33 to form the reinforcement cage. The process of lifting template 29 and bars 33 upward from hole 20 continues until the last horizontal tie 26 has been affixed and the cage 40 has been completed.

Figures 5, 6, 7, 8:
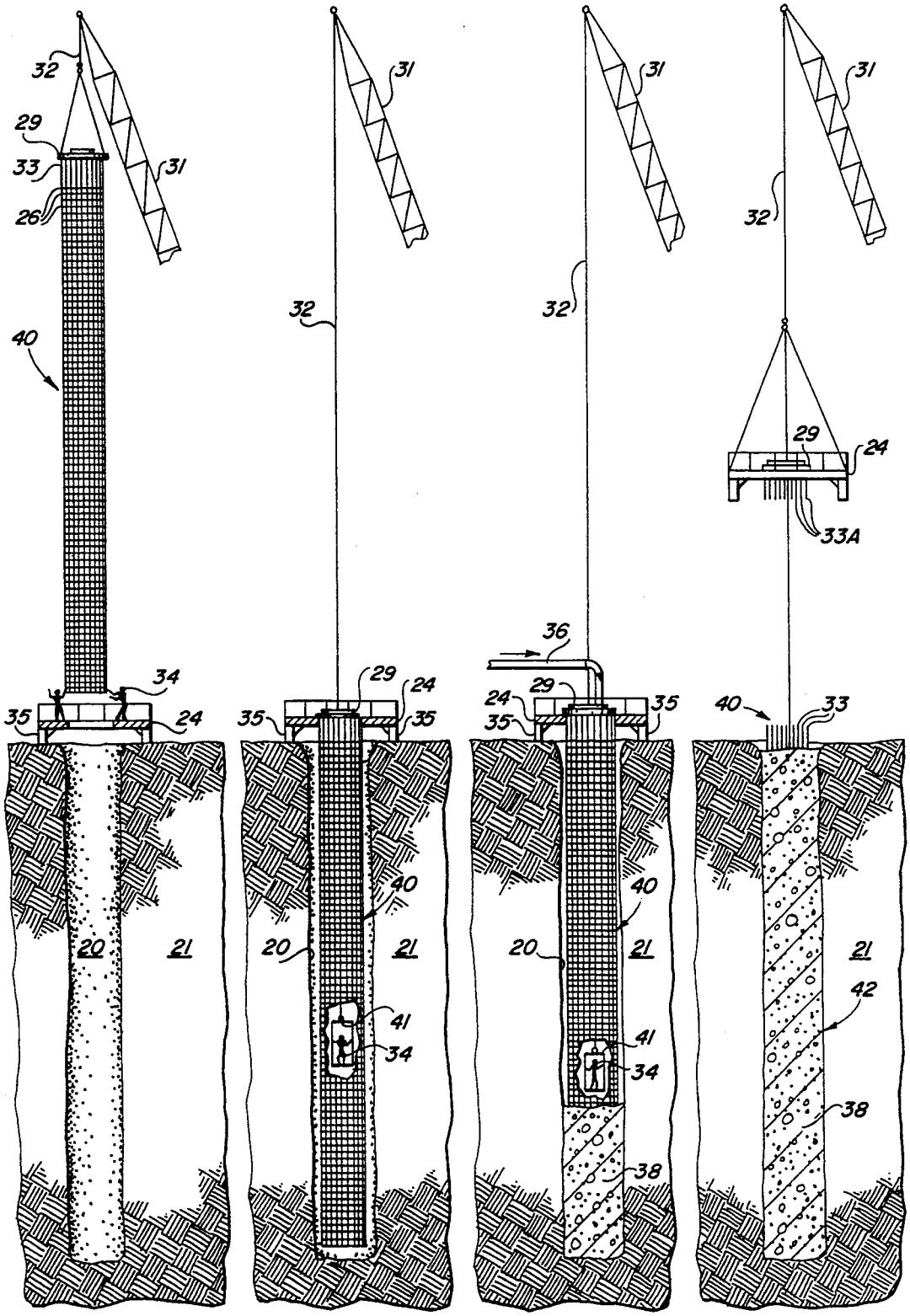
FIG. 5 shows the completed reinforcing cage suspended above the hole in the earth, having had all horizontal tie rings attached thereto.
FIG. 6 shows the reinforcing cage suspended from its template and lowered back into the hole in the earth. A workman is suspended within the cage inspecting the alignment of the cage with the sides of the hole.
FIG. 7 illustrates the manner in which concrete is poured into the suspended reinforcing cage so as to fill the interiors of both the cage and hole in the earth.
FIG. 8 shows the completed reinforced concrete pier provided upon curing of the concrete which was deposited into the earth hole, and the severing of the vertical reinforcing bars of the reinforcing cage. The work platform and suspension template with remnants of vertical reinforcing bars are shown being moved to another location.

In FIG. 5 the completed reinforcing cage 40 is shown suspended above hole 20. The lower work platform 23 and motorized tie containment unit 27 have been removed and work platform 24 has been repositioned above hole 20. Work platform 24 is preferably supported on tripod legs 35 which are telescopically adjustable so that platform 24 may be leveled and the vertical disposition of reinforcing cage 40 adjustably assured after cage 40 is lowered back into hole 20 with template 29 affixed to the surface of work platform 24.

This situation is depicted in FIG. 6 wherein reinforcing cage 40 has been lowered into hole 20 and is supported by template 29 which rests atop work platform 24. A personal lift cage 41 may be passed through template 29 and down through the inside of reinforcing cage 40 to permit a workman 34 to inspect the interior of cage 40 and the alignment of the cage with the sides of hole 20. Adjustments may be made in the positioning of the sides of cage 40 with respect to the sides of hole 20 by adjustment of the telescoping legs 35 of work platform 24. Once the inspection is complete and the inspecting workman has left the cage, preparations may be made for filling cage 40 and hole 20 with concrete.

In the situation depicted in FIG. 7, a concrete supply line 36 has been coupled to the interior of reinforcing cage 40 and to a source 37 of concrete, not shown. Sufficient concrete 38 has been deposited to fill the lower portions of hole 20 and reinforcing cage 40. As FIG. 7 suggests an inspecting workman 34 may once again be lowered by means of personnel lifter 41 down inside cage 40 to inspect the placement of concrete therein.

When the hole 20 has been filled with concrete 38 as in FIG. 8, and the concrete allowed to cure, vertical reinforcing bars 33 are cut to the specified elevation required at the site at which the reinforced concrete pier 42 was constructed. Thereafter, work platform 24, bearing template 29 and the remnants 33A of vertical reinforcing bars 33, is lifted from the site and transported for use elsewhere.

What has just been disclosed is method and apparatus for fabricating a drilled, concrete pier in the earth at a construction site. The earth is drilled to a selected, specified depth and horizontal tie rings to be used in the construction of a reinforcing cage are positioned above the hole. A template for supporting the vertical reinforcing bars of the reinforcement cage is, in turn, positioned above the horizontal ties. Vertical reinforcing bars having a length somewhat greater than the finished length of the reinforcing cage are deposited through the template and reinforcing rings to hang from the template down into the drilled hole in the earth.

When all vertical bars have been positioned and suspended from the template, the workmen begin fastening horizontal tie rings to the vertical bars. As the horizontal tie rings are assembled to the vertical bars, the template, from which the vertical bars are suspended, is lifted out of the hole so that the attachment of the horizontal tie rings may continue apace. When the last horizontal tie ring has been assembled to the vertical tie bars, the reinforcing cage has been fully constructed and consists of a completed assembly suspended above the earth-drilled hole.

Thereafter, the finished cage, still coupled to the template is lowered into the hole and the template position adjusted to establish correct spacing between the walls of the reinforcing cage and the walls of the hole. Personnel may travel by personnel lift down into the reinforcing cage to check its position and to oversee the placement of concrete within the reinforcing cage. Concrete is poured into the reinforcing cage and the hole filled. Then, the vertical reinforcing bars are cut to the established elevation for the particular construction site and the template removed for use at the next site.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention, THAT WHICH IS CLAIMED IS:

1. A method for fabricating a drilled, concrete pier in the earth at a construction site comprising the steps of:
   - drilling a hole in the earth to a selected, specified depth;
   - positioning above the hole horizontal tie rings to be used in the construction of a reinforcing cage;
   - providing a template for supporting the vertical reinforcing bars of said reinforcement cage;
   - positioning said template above said horizontal ties;
   - providing vertical reinforcing bars having a length somewhat greater than the finished length of said reinforcing cage;
   - depositing said reinforcing bars through said template and reinforcing rings and hanging said bars from said template suspended downward into the drilled hole in the earth.
   - fastening said horizontal tie rings to said vertical bars when all said vertical bars have been positioned and suspended from said template;
   - as the horizontal tie rings are assembled to the vertical bars, lifting said template out of the hole so that the attachment of the horizontal tie rings may continue apace;
   - completing the assembly of said reinforcement cage suspended above the earth-drilled hole;
   - lowering said finished cage, still coupled to said template, into said hole; and
   - adjusting the position of said template to establish correct spacing between the walls of the reinforcing cage and the walls of said hole.

2. The method of claim 1 further comprising the step of admitting inspection personnel down into the reinforcing cage to check its position within said hole.

3. The method of claim 1 further comprising the step of admitting inspection personnel down into the reinforcing cage to check its position and to oversee the placement of concrete within the reinforcing cage.

4. The method of claim 1 further comprising the step of pouring concrete into said reinforcing cage and said hole until said hole is filled.

5. The method of claim 4 further comprising the step of cutting said vertical reinforcing bars to the established elevation for the particular construction site and removing said template later use elsewhere.

6. A method for fabrication of a steel reinforcement cage for use in drilled pier foundations, said reinforcement cage comprising vertical reinforcement bars and horizontal ties, said method comprising the steps of:

drilling a hole int h earth to a selected, specified depth;

providing a template from which said vertical reinforcement bars may be suspended and disposed in spatial alignment generally defining the periphery of said reinforcement cage;

positioning above said hole said horizontal ties;

positioning said template for supporting the vertical reinforcing bars of said reinforcement cage above said horizontal ties;

providing said vertical reinforcing bars in a length selected to be greater than the selected finished length of said reinforcing cage;

depositing said reinforcing bars through said template and reinforcing ties, so tat all said vertical reinforcement bars of said reinforcement cage are in vertical disposition from said template;

hanging said bars from said template suspended downward into the drilled hole in the earth;

positioning a said horizontal tie at a selected site along the length of said reinforcement bars when all said vertical bars have been positioned and suspended from said template;

fastening said horizontal tie to said vertical bars at said selected site;

repeating the steps of positioning and fastening said horizontal ties to said vertical reinforcement bars to a selected finished length;

as the horizontal ties are fastened to the vertical bars, lifting said vertical bars out of the hole so that the attachment of the horizontal ties may continue apace;

completing the assembly of said reinforcement cage suspended above the earth-drilled hole while said cage is vertically suspended from said template;

lowering said finished cage, still coupled to said template, into sd hole; and adjusting the position of said template to establish correct spacing between the walls of the reinforcing cage and the walls of said hole.

* * * * *